US011351080B2

(12) United States Patent
Mackin et al.

(10) Patent No.: US 11,351,080 B2
(45) Date of Patent: Jun. 7, 2022

(54) PATIENT CARE DEVICE WITH RETRACTABLE HEATER ELEMENT

(71) Applicant: International Biomedical, Ltd., Austin, TX (US)

(72) Inventors: Michael H. Mackin, Ellicott City, MD (US); Christopher A. Dykes, Columbia, MD (US)

(73) Assignee: International Biomedical, Ltd., Austin, TX (US)

( * ) Notice: Subject to any disclaimer, the term of this patent is extended or adjusted under 35 U.S.C. 154(b) by 258 days.

(21) Appl. No.: 16/674,028

(22) Filed: Nov. 5, 2019

(65) Prior Publication Data

US 2020/0069496 A1 Mar. 5, 2020

Related U.S. Application Data

(62) Division of application No. 14/863,363, filed on Sep. 23, 2015, now Pat. No. 10,500,116.

(60) Provisional application No. 62/054,014, filed on Sep. 23, 2014.

(51) Int. Cl.
*A61G 11/00* (2006.01)

(52) U.S. Cl.
CPC ..... *A61G 11/003* (2013.01); *A61G 11/005* (2013.01)

(58) Field of Classification Search
CPC ..... A61G 11/00; A61G 11/001–009
See application file for complete search history.

(56) References Cited

U.S. PATENT DOCUMENTS

| | | | | |
|---|---|---|---|---|
| 3,858,570 | A | 1/1975 | Beld et al. | |
| 4,936,824 | A | 6/1990 | Koch et al. | |
| 5,453,077 | A | 9/1995 | Donnelly et al. | |
| 5,759,149 | A | 6/1998 | Goldberg et al. | |
| 5,830,123 | A | 11/1998 | Franz et al. | |
| 6,224,539 | B1 | 5/2001 | Jones et al. | |
| 6,231,499 | B1 | 5/2001 | Jones | |
| 6,350,228 | B1 | 2/2002 | Richards et al. | |
| 6,506,147 | B2 | 1/2003 | Eustace et al. | |
| 6,953,427 | B1 * | 10/2005 | Mackin | A61G 11/00 600/22 |
| 8,858,417 | B2 | 10/2014 | Khodak et al. | |
| 9,233,040 | B2 | 1/2016 | Matsubara et al. | |
| 2002/0032361 | A1 * | 3/2002 | Eustace | A61G 11/00 600/22 |
| 2013/0345494 | A1 | 12/2013 | Matsubara et al. | |
| 2015/0182722 | A1 | 7/2015 | Lesch et al. | |
| 2015/0272802 | A1 | 10/2015 | Tsitlik et al. | |
| 2015/0335510 | A1 | 11/2015 | Cipriano et al. | |

(Continued)

OTHER PUBLICATIONS

Ohmeda Medical, "Giraffe OmniBed Operator's Manual", Aug. 1, 2001, 55 pages.

(Continued)

*Primary Examiner* — Carrie R Dorna
(74) *Attorney, Agent, or Firm* — Barnes & Thornburg LLP

(57) ABSTRACT

An infant care device and, more particularly, an apparatus for providing the combined functions of an infant incubator and a radiant infant warmer and which includes a radiant heater assembly contained within a housing and mechanisms and methods to quickly reduce the heating from the radiant heater assembly when the infant care device is quickly converted from an open infant radiant warming device to an enclosed incubator.

15 Claims, 7 Drawing Sheets

(56) References Cited

U.S. PATENT DOCUMENTS

| | | | |
|---|---|---|---|
| 2016/0015585 | A1 | 1/2016 | Sabota |
| 2016/0015586 | A1 | 1/2016 | Sabota et al. |

OTHER PUBLICATIONS

Medical Devices Agency, "evaluation No. 02090, Neonatal Incubator/Infant Radiant Warmer, Ohmeda Giraffe OmniBed", Jul. 2002, 24 pages.

* cited by examiner

PATIENT CARE DEVICE WITH RETRACTABLE HEATER ELEMENT

CROSS REFERENCE TO RELATED APPLICATIONS

This application is a divisional of U.S. patent application Ser. No. 14/863,363, filed Sep. 23, 2015, and claims the benefit of U.S. Provisional Patent Application Ser. No. 62/054,014, filed Sep. 23, 2014. The entire disclosures of the foregoing applications are hereby incorporated by reference.

BACKGROUND

This disclosure relates to an infant care device and, more particularly, to an apparatus for providing the combined functions of an infant incubator and an infant warmer and which includes a radiant heater assembly contained within a housing and mechanisms to quickly reduce the heating from a radiant heater assembly when the infant care device is quickly converted from an open infant radiant warming device to an enclosed incubator.

Infants often require additional heat to maintain their body at a normal temperature. One device that can provide this additional heating is a special kind of bed that can convert from an open radiant warmer to an enclosed incubator. The open radiant warmer primarily heats using a radiant heater that focuses heat on to the bed surface. When the bed is converted into an enclosed incubator the primary heat is provided by forced air heating using a blower and an air heater typically located under the patient bed.

A problem experienced with a bed that converts from open radiantly heated bed to an enclosed incubator is preventing the radiant heat from overheating the infant while the radiant heating element cools down after the bed has transitioned to an incubator configuration.

There are, of course, many devices or apparatus for the warming of an infant and to supply the necessary heat to maintain the infant at a predetermined temperature. Of the various apparatus, there are infant warmers that are basically planar surfaces on which the infant is positioned and which planar surfaces generally include side guards to keep the infant safely within the confines of the apparatus. Infant warmers normally have an overhead radiant heater that is located above the infant and which thus radiates energy in the infrared spectrum to impinge upon the infant to maintain the infant at a warm, predetermined temperature. Since the infant is otherwise totally exposed to the surroundings, there is almost unlimited access to the infant by the attending personnel to perform various procedures on that infant. At typical infant warmer is shown and described in U.S. Pat. No. 5,474,517 of Falk et al as prior art to that patent.

There are also infant incubators and which are more confined enclosures that contain the infant within an enclosed controlled atmosphere in an infant compartment that provides heat to the infant and also may provide control of humidity in the enclosed environment. Such incubators maintain the infant for long periods of time and include handholes to access the infant and/or there is normally a larger access door that can be opened to access the infant or to insert or remove the infant to and from the incubator. Such devices provide a good atmosphere to the infant and control that local environment within which the infant is located, however, it is sometime difficult to perform a wide variety of procedures on the infant due to the somewhat limited access to that infant. A typical infant incubator is shown and described in U.S. Pat. No. 4,936,824 of Koch et al.

At the present, there are also certain infant care apparatus that combine the functions of an infant warmer and an incubator. One such apparatus is shown and described in U.S. Pat. No. 5,453,077 of Donnelly et al and which has an overhead canopy including an infrared heater and the canopy and heater are raisable and lowerable with respect to an infant positioned in the apparatus. Therefore, the device can operate as an incubator when the canopy and heater are in the lowered position and can act as an infant warmer when the canopy and the heater are in the upper position.

One difficulty, however, is in the raising and lowering of the heater. It is important to insure that the infant as well as the attending personnel are not subjected to the possibility of touching any of the heated surfaces of the heater or components that are warmed by contact or close proximity to that heater. In addition, it is also important that radiant energy from the various heated surfaces connected with the heater, as well as convective heat not continue to be emitted from those surfaces when the heater is in close proximity to the infant. As such, therefore it is advantageous that the heater be lowered fairly rapidly when the user decides to convert the operation from that of an infant warmer to that of an infant incubator and where the heater is lowered to the incubator position in close proximity to the infant. The heater itself takes a certain period of time to cool down and normal lowering of the heater does not afford sufficient time for that cool-down to take place.

Accordingly, when the heater is lowered, there are still surfaces of the heater and its housing that are hot spots and which continue to radiate heat that is focused in the direction of the infant only at that point, the heater is located at a close proximity to the infant. Thus those hot spots can cause localized heated areas of the infant and the effect potentially harmful to the infant. It is therefore, important that some means be provided to prevent those surfaces from radiating to the infant or from being inadvertent touched by the infant or any of the attending personnel.

Although the solution proposed here can be applied in any number of patient care devices the example to be shown is for an infant warming device. A variety of various infant warming devices are used to provide heat support to premature infants who cannot sustain their own body temperature. In the treatment of infants, and particularly those born prematurely, it is necessary to provide heat to the infant during the care and treatment of the infant and to minimize heat loss from the infant's body. An apparatus for providing such heat will be referred to in this disclosure as an infant warming device. In general such an apparatus comprises a flat planar surface on which the infant rests while various procedures are carried out. There are normally protective guards that surround the infant and some type of overhead heater directing radiant energy toward the infant. It should be understood that these infant warming devices might have other descriptive names, such as, for example, an infant care device, or an infant care center, patient care center, an infant incubator, or a combination device, and this disclosure anticipates any of those other names. This disclosure will use the term infant warming device.

SUMMARY

This inventive concept to be described involves three main elements: a heater element, a reflector, and a deflector. When the infant care device is functioning as a radiant heater the heating element is positioned within the reflector and works in conjunction with the deflector to focus the radiant heat on the targeted area, the patient bed or mattress. When the infant care device is configured as an incubator the radiant heater element is blocked or reduced in intensity from the reflector by various inventive embodiments to prevent or reduce the radiant heat from the heater element to radiate the reflector and thus direct excess radiant power toward the infant.

In one embodiment there is an infant care apparatus that can convert from an open radiant warmer configuration to an enclosed incubator configuration including at least: a mattress on a base support; clear sidewalls with an open top surrounding said mattress; a vertical member extending upwardly from said surface; a canopy containing a radiant heater assembly mounted to said vertical member and being movable along said vertical member between an upper open radiant heater position above said surface and an lower incubator position in which the canopy is positioned on the top of the clear sidewalls, forming a closed incubator; said radiant heater assembly comprising a radiant heater element extending through an opening in a radiant heater reflector that directs heat downward toward the surface on which an infant is positioned, and a radiant heater deflector surrounding a lower end of the radiant heater element for deflecting heat from the radiant heater onto the radiant heater reflector and down toward the mattress; wherein when in an open radiant heater configuration said radiant heater element extends through an opening in the radiant heater reflector, in order to effectively radiate heat downward toward the surface on which the infant is positioned, and when in an incubator configuration said radiant heater assembly comprising a radiant heater element extending through an opening in a radiant heater reflector is retracted through the opening in the radiant heater reflector to remove the radiant heater element from the closed incubator.

In another embodiment there is an infant care apparatus that can convert from an open radiant warmer configuration to an enclosed incubator configuration including at least: a mattress on a base support; clear sidewalls with an open top surrounding said mattress; a vertical member extending upwardly from said surface; a canopy containing a radiant heater assembly mounted to said vertical member and being movable along said vertical member between an upper open radiant heater position above said surface and an lower incubator position in which the canopy is positioned on the top of the clear sidewalls, forming a closed incubator; said radiant heater assembly comprising a radiant heater element extending through an opening in a radiant heater reflector that directs heat downward toward the surface on which an infant is positioned, and a radiant heater deflector surrounding a lower end of the radiant heater element for deflecting heat from the radiant heater onto the radiant heater reflector and down toward the mattress; wherein when in an open radiant heater configuration said radiant heater element extends through an opening in the radiant heater reflector, in order to effectively radiate heat downward toward the surface on which the infant is positioned, and when in an incubator configuration said radiant heater assembly comprising a radiant heater element extending through an opening in a radiant heater reflector is retracted through the opening in the radiant heater reflector to remove the radiant heater element from the closed incubator.

In another embodiment there is an infant care apparatus that can convert from an open radiant warmer configuration to an enclosed incubator configuration including at least: a mattress on a base support; clear sidewalls with an open top surrounding said mattress; a vertical member extending upwardly from said surface; a canopy containing a radiant heater assembly mounted to said vertical member and being movable along said vertical member between an upper open radiant heater position above said surface and an lower incubator position in which the canopy is positioned on the top of the clear sidewalls, forming a closed incubator; said radiant heater assembly comprising a radiant heater element extending through an opening in a radiant heater reflector that directs heat downward toward the surface on which an infant is positioned, and a radiant heater deflector surrounding a lower end of the radiant heater element for deflecting heat from the radiant heater onto the radiant heater reflector and down toward the mattress; wherein when in an open radiant heater configuration said radiant heater element extends through an opening in the radiant heater reflector, in order to effectively radiate heat downward toward the surface on which the infant is positioned, and when in an incubator configuration said radiant heater assembly comprising a radiant heater element extending through an opening in a radiant heater reflector is retracted through the opening in the radiant heater reflector to remove the radiant heater element from the closed incubator.

In another embodiment there is an infant care apparatus that can convert from an open radiant warmer configuration to an enclosed incubator configuration comprising: a mattress on a base support; clear sidewalls with an open top surrounding said mattress; a vertical member extending upwardly from said surface; a canopy containing a radiant heater assembly mounted to said vertical member and being movable along said vertical member between an upper open radiant heater position above said surface and an lower incubator position in which the canopy is positioned on the top of the clear sidewalls, forming a closed incubator; said radiant heater assembly comprising a radiant heater element extending through an opening in a radiant heater reflector that directs heat downward toward the surface on which an infant is positioned, and a radiant heater deflector surrounding a lower end of the radiant heater element for deflecting heat from the radiant heater onto the radiant heater reflector and down toward the mattress; wherein when in an open radiant heater configuration said radiant heater element extends through an opening in the radiant heater reflector, in order to effectively radiate heat downward toward the surface on which the infant is positioned, and when in an incubator configuration said radiant heater assembly comprising a radiant heater element extending through an opening in a radiant heater reflector is retracted by degrees through the opening in the radiant heater reflector to defocus the heating effect of the radiant heater element and effectively achieve reduced heating of the mattress in the incubator mode.

BRIEF DESCRIPTION OF THE DRAWINGS

There are disclosed in the drawings and detailed description to follow various embodiments of the solution proposed herein. It should be understood, however, that the specific embodiments given in the drawings and entailed description do not limit the disclosure. On the contrary, they provide the foundation for discerning the alternative forms, equivalents, and modifications that will be encompassed in the scope of the eventual claims.

DETAILED DESCRIPTION

Figure 1:
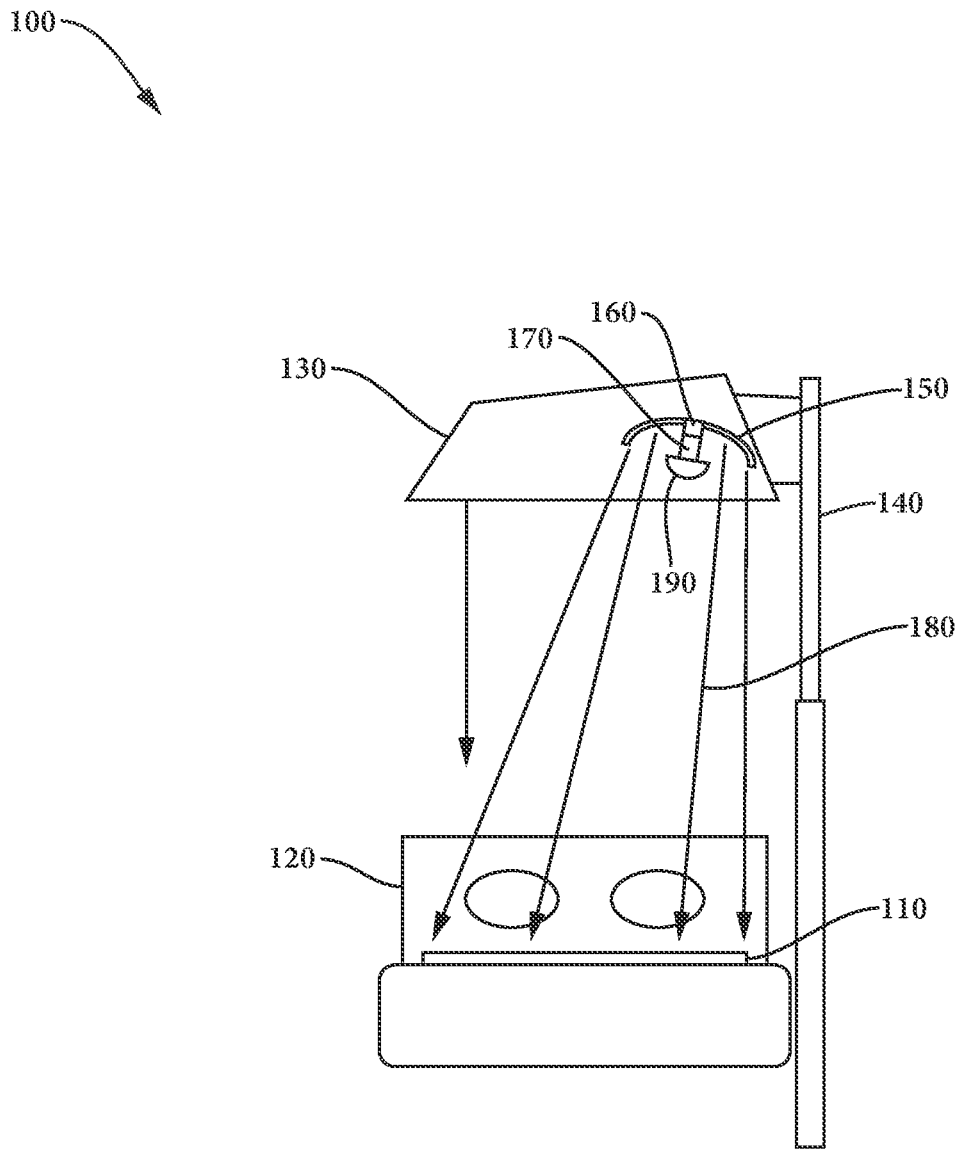
FIG. 1 is a view of an infant care center in its radiant warming mode that can include the inventive concept described in this disclosure.

Examining FIG. 1, shown generally as the numeral 100, can describe the concept. In this illustration the infant care device is functioning as an open radiant warmer. A mattress 110 lies on a base support and is surrounded usually by clear sidewalls 120 of a type of transparent plastic. Situated overhead is a canopy 130 supported by a collapsible support 140. The canopy supports a radiant heater assembly that includes a radiant element 170 attached to an upper end piece 160 that extends slightly into a curved reflector 150. Radiant heater element 170 extends downward into a deflector element 190 that serves to deflect radiant heat from the lower end of heater element 170 back to the reflector 150 and back down toward mattress 110.

While operating in the radiantly heated open bed configuration the heater element often operates at a very high temperature in order to provide sufficient radiant heat to the mattress. When transitioning from open bed configuration to enclosed bed configuration (to be shown) it is important to complete the transition in a short period of time (10-15 seconds) to minimize the time between stable warming conditions.

Unfortunately, this time is not sufficient to cool down the radiant heater element. If nothing were done with the hot radiant heater the infant would be exposed to very high temperatures and possible overheating when the canopy closes.

One solution to this problem as described in U.S. Pat. No. 6,224,539 is to use a door or doors that close and enclose the radiant heater (heat element, reflector, and deflector) separating it from the infant's compartment.

This disclosure provides better solutions to the problem. The solutions proposed solve the problem by different embodiments that act to remove the exposed radiant heater element from the infant's compartment. There are a number of ways to accomplish this. In a preferred method the heating element is withdrawn from the compartment.

Figure 2:
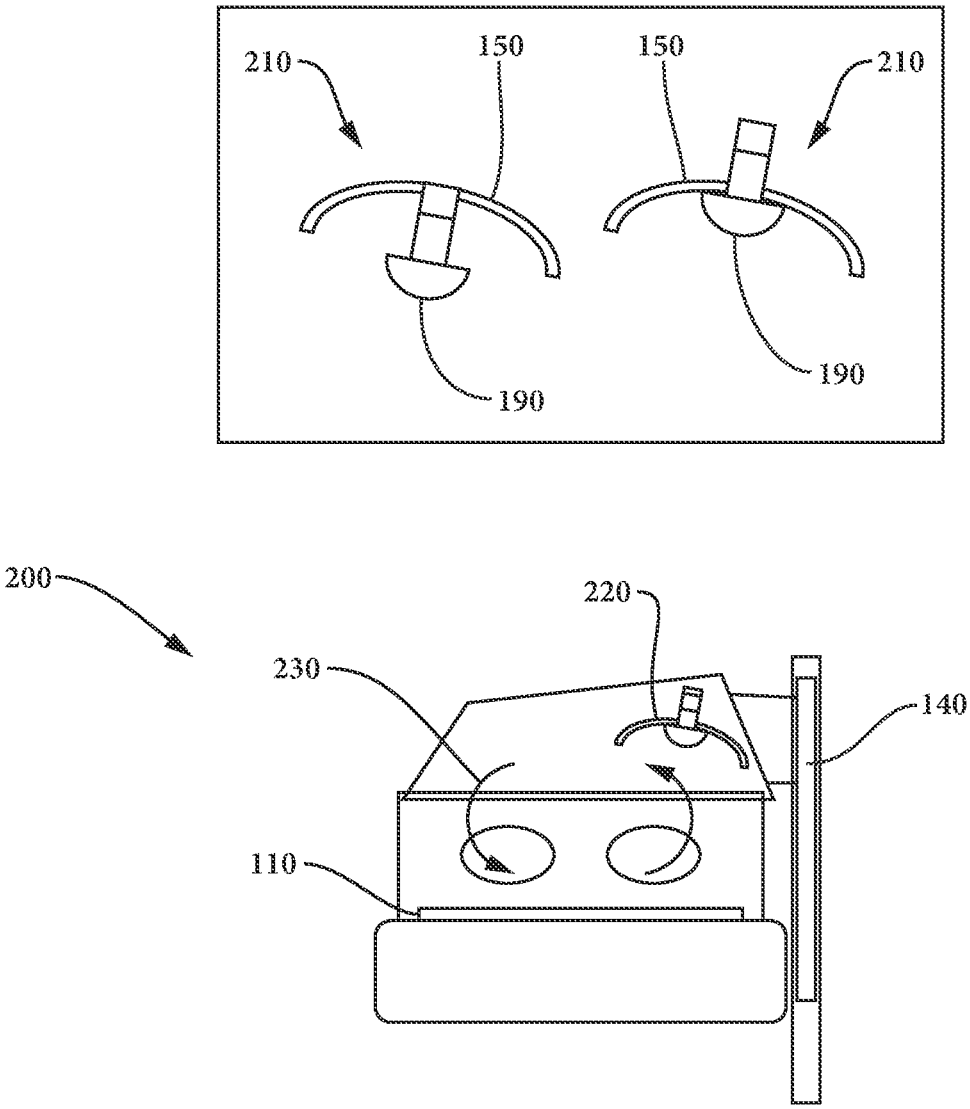
FIG. 2 is an alternate view of an infant care center in its enclosed (incubator) mode that can include the inventive concept described in this disclosure.

Moving on to FIG. 2, the infant care device is shown generally by the numeral 200. Collapsible support 140 has been lowered to bring canopy 130 down to enclose the mattress 110 and clear sidewall 120 combinations, creating an incubator. The radiant heater assembly (radiant heater element, deflector, and reflector), shown generally as the numeral 220 is rapidly moved closer to the infant mattress. As the canopy is lowered the radiant heater assembly configuration is quickly changed from the illustrated position 210 to the illustrated position 220, in which the radiant heater element is withdrawn from the compartment through an appropriately sized hole in the reflector and the deflector acts to seal the radiant heater assembly against the reflector, effectively removing the still hot radiant heater element from compartment. When withdrawn as described the hot element is isolated from the infant and the heat can be dissipated over time. There might be vents that allow heat to escape from the back of the reflector, possibly even a small blower. But in an alternate embodiment, as the canopy is transitioning from an open bed radiant heater to a closed bed incubator, a fan or natural convective venting (not shown) could be used to remove the residual heat from the radiant heater, but vent it into the infant compartment (see flow 230) to minimize the thermal ramp up time to a stable incubator environment.

Figure 3:
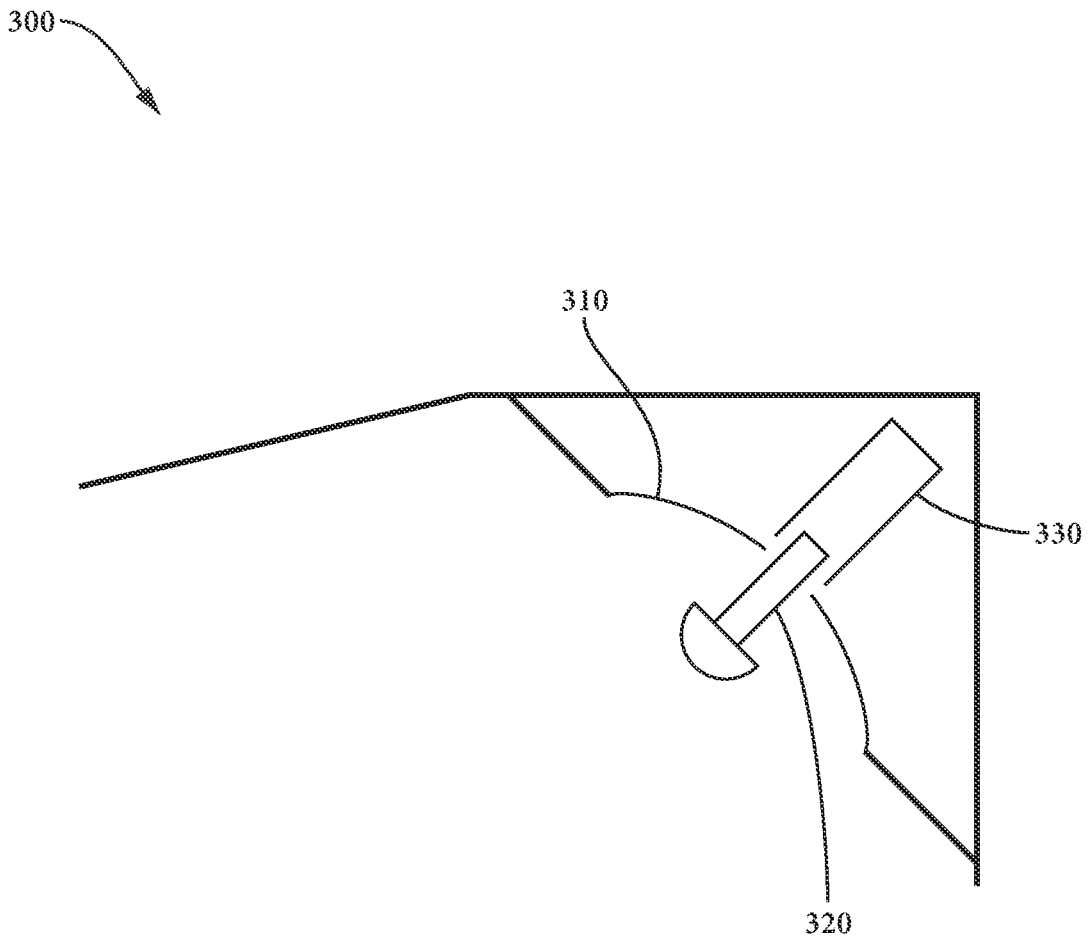
FIG. 3 is an alternate embodiment of an inventive concept that can be used in the infant care center.
Figure 4:
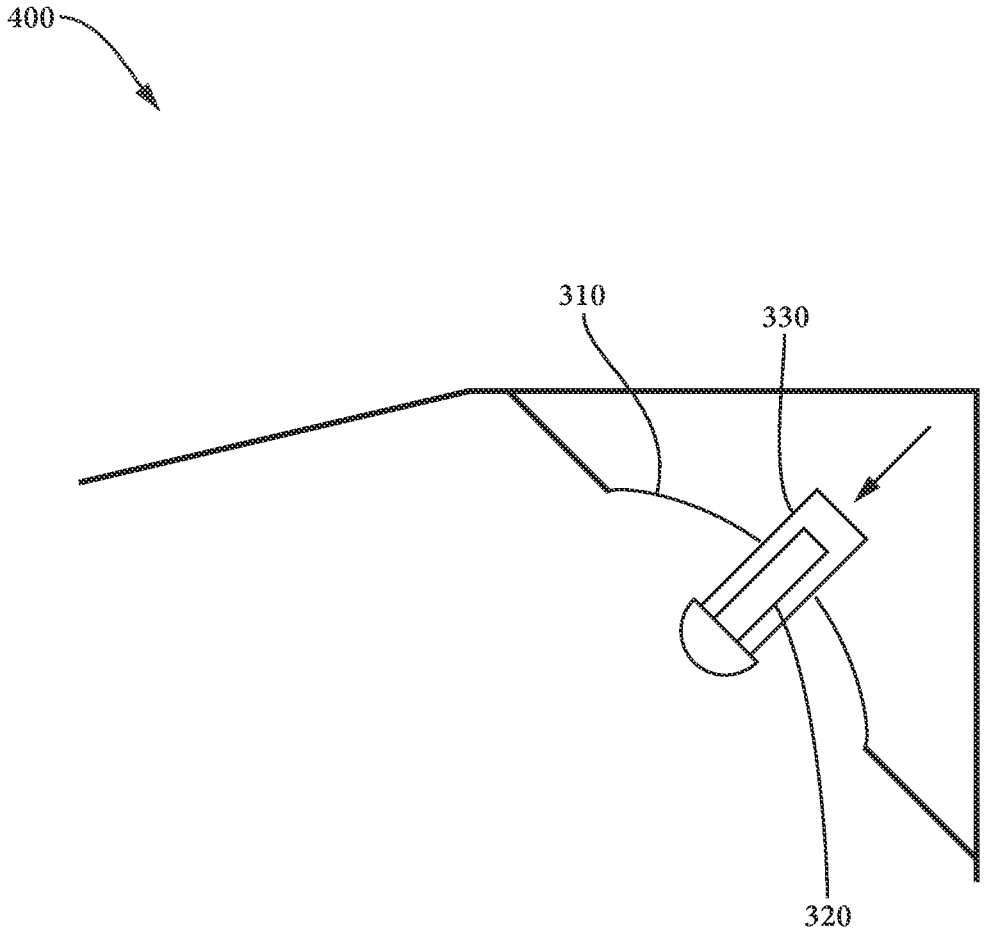
FIG. 4 is a second configuration of the alternate embodiment of FIG. 3.

An alternate embodiment can be seen in FIGS. 3 and 4. In this approach, as shown in FIG. 3, the radiant heater element 320 is deployed within the curve of the reflector element 310, thus radiating heat down toward the mattress when the infant care device is in its infant warmer mode. But behind the radiant heater element a sheath 330 is stowed.

Figure 5:
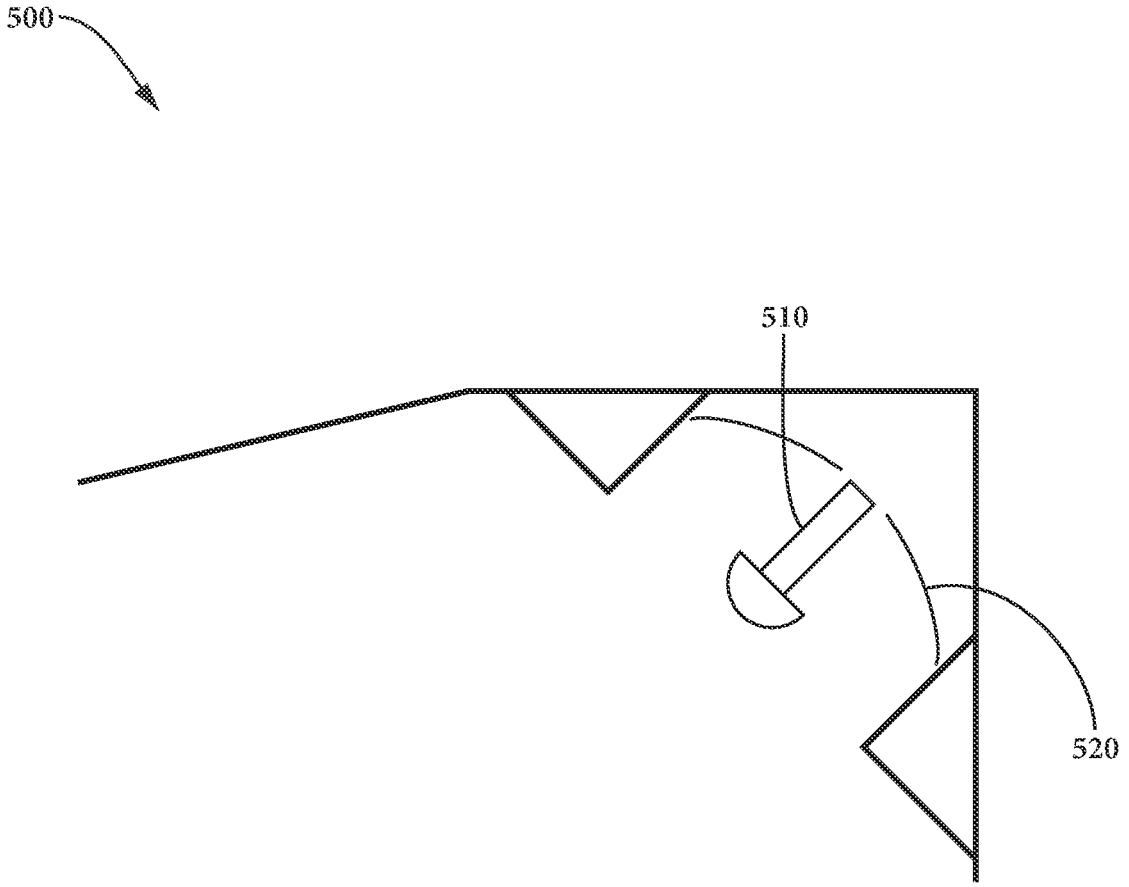
FIG. 5 is another alternate embodiment of an inventive concept that can be used in the infant care center.
Figure 6:
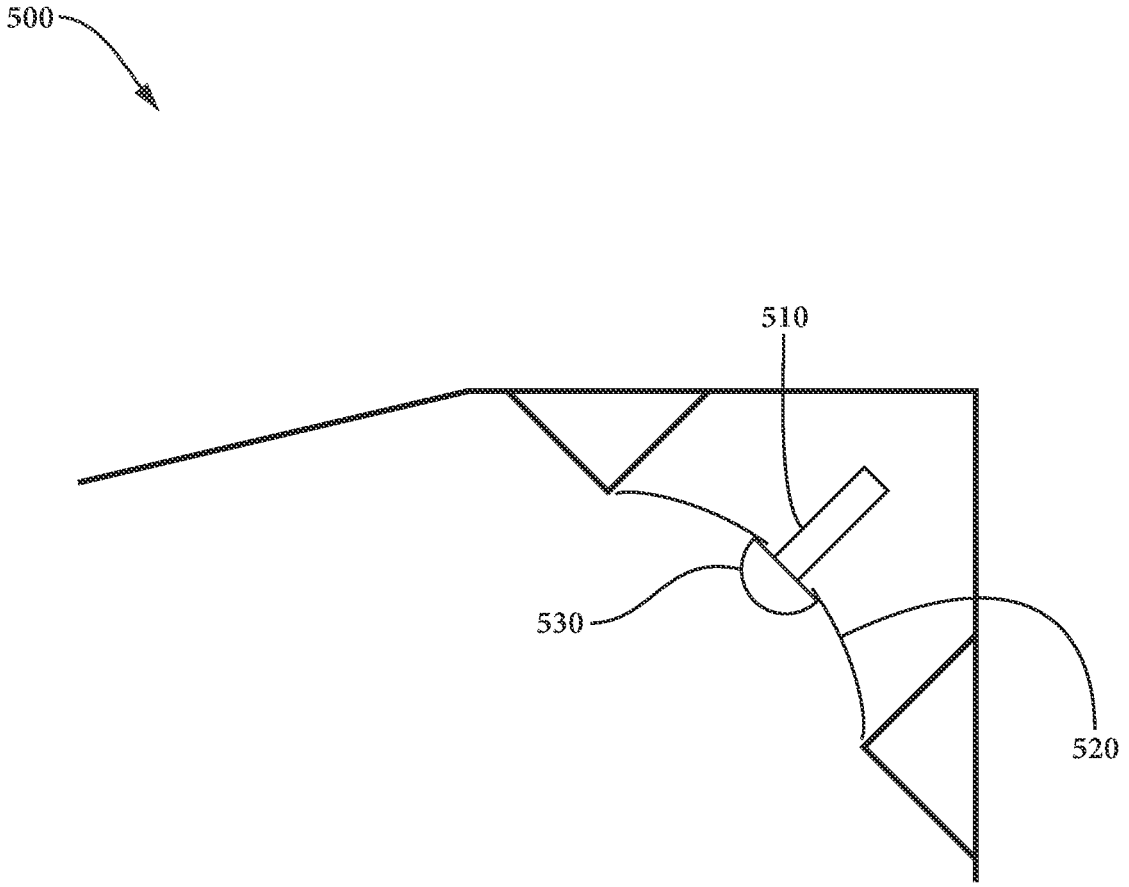
FIG. 6 is a second configuration of the alternate embodiment of FIG. 5.

Moving on to FIG. 4, when the infant care device is moved into its incubator mode sheath 330 is mechanically moved through a hole in the reflector to completely cover the still hot radiant heater element, eliminating most of the radiant heat form the container immediately. Again, the heat from the radiant heater element can then dissipate over time. There might be vents that allow heat to escape from the back of the reflector, possibly even a small blower. And an alternate embodiment, as the canopy is transitioning from an open bed radiant heater to a closed bed incubator, a fan or natural convective venting (not shown) could be used to remove the residual heat from the radiant heater, but vent it into the infant compartment (see flow 230 in FIG. 2) to minimize the thermal ramp up time to a stable incubator environment An alternate embodiment can be seen in FIGS. 5 and 6, shown generally as the number 500. In this embodiment the radiant heater element 510 is fixed in place and a movable reflector surface 520 is place initially slightly behind element 510. This is the infant warmer radiant heated mode.

Moving on to FIG. 6, as the infant warmer is converted to the incubator mode, the reflector 520 is quickly moved forward until the reflector effectively seals the radiant heater element 110 from exposing the mattress in the container. Again, the heat from the radiant heater element can then dissipate over time. There might be vents that allow heat to escape from the back of the reflector, possibly even a small blower. And an alternate embodiment, as the canopy is transitioning from an open bed radiant heater to a closed bed incubator, a fan or natural convective venting (not shown) could be used to remove the residual heat from the radiant heater, but vent it into the infant compartment (see flow 230 in FIG. 2) to minimize the thermal ramp up time to a stable incubator environment A final concept is described in FIG. 7. Four positions are illustrated. In position 1 the heater element is placed in the optimum location within the reflector to focus the infrared rays on the bed most effectively when the canopy is opened and the radiant heater is at it's farthest from the mattress. Position 2 shows the heater still in the extended location within the reflector; however the area heated has been reduced greatly because the radiant heater is so near the mattress. Position 3 describes an embodiment where the heater has been moved up into the reflector, defocusing the radiant heater assembly (reflector, heater element and deflector). This is much like moving the bulb of a flashlight in and out of the reflector to change the area illuminated.

By defocusing the radiant heater in this manner it is possible to continue to heat with the radiant heater when the canopy is closed, but to do so with the radiant heater defocused and at a much lower power level.

And finally in Position 4 the heater element can be completely withdrawn to remove the heating element from the enclosure.

The disclosure presented describes multiple positions of both the heater element, in some embodiments a sheath, and the canopy that can enclose the mattress, creating in effect an incubator. These various movements can all be powered. One prototyped mechanism is a simple slider/crank mechanism using a serve or stepper motor. Another workable approach is the use of linear screw drives and limit switches. It should also be possible to power the heater or sheath movements off the canopy lift mechanism using cables, pulleys, and springs.

In a preferred embodiment all of these powered movements would be performed automatically, with the various movements programmed to execute when a user pushes a switch or button. It is also possible for a user to perform some of these functions manually, but not preferred.

Figure 7:
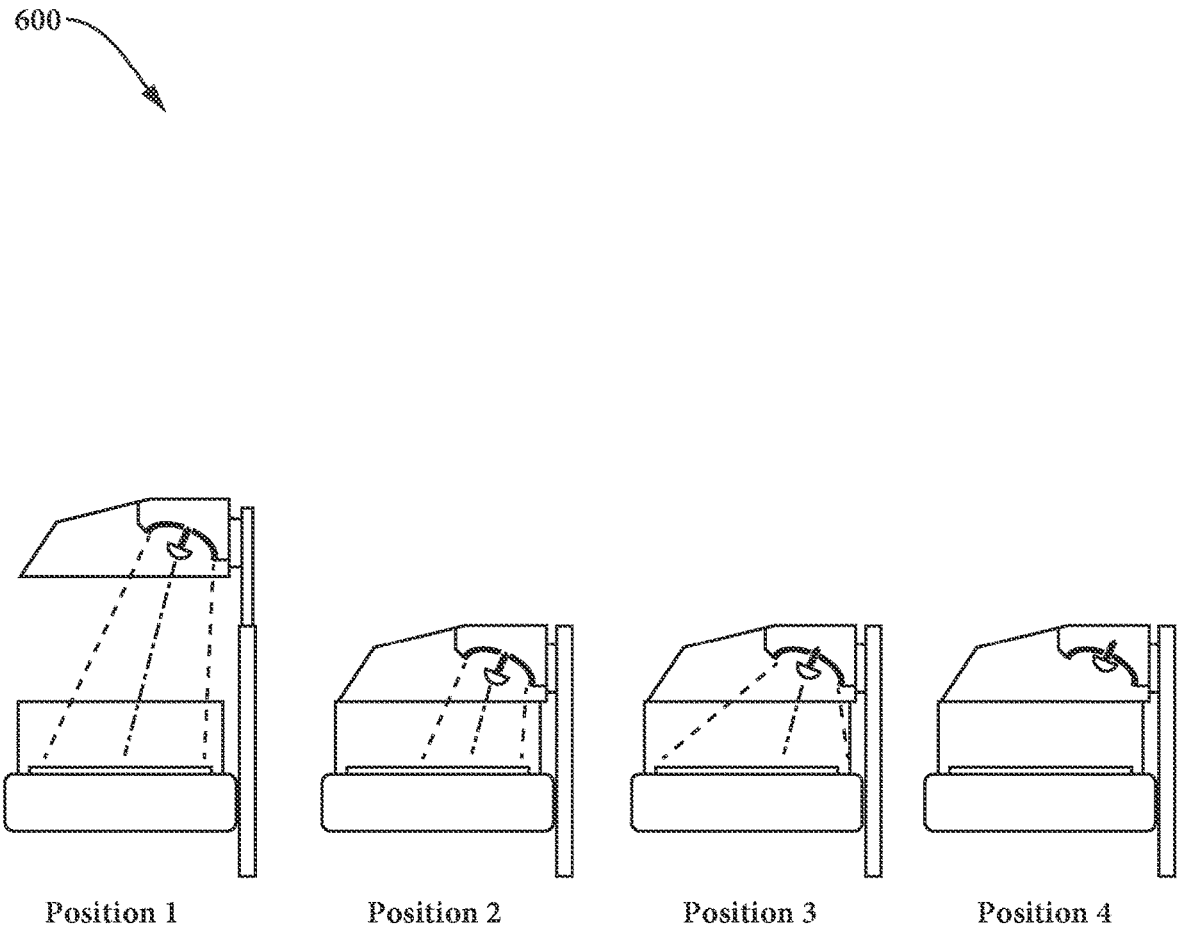
FIG. 7 is another alternate embodiment of an inventive concept that can be used in the infant care center.

In the final embodiment described—the embodiment shown in FIG. 7 in which the heater has been moved up into the reflector by degrees, effectively defocusing the radiant heater assembly (reflector, heater element and deflector), the defocusing could be automated using temperature feedback from the incubator to adjust the degree of defocusing automatically. Alternately the degree of defocusing could be done manually.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

What is claimed is:

1. An infant care apparatus that can convert from an open radiant warmer configuration to an enclosed incubator configuration, the infant care apparatus comprising:

a mattress on a base support surface;

clear sidewalls with an open top surrounding said mattress;

a vertical member extending upwardly from said surface; and a canopy containing a radiant heater assembly mounted to said vertical member, the canopy being movable along said vertical member between (i) an upper open radiant warmer position above said surface and (ii) a lower incubator position in which the canopy is positioned on the top of the clear sidewalls forming a closed incubator;

wherein said radiant heater assembly comprises (i) a radiant heater element extending through an opening in a radiant heater reflector that directs heat downward toward the mattress and (ii) a radiant heater deflector surrounding a lower end of the radiant heater element for deflecting heat from the radiant heater element onto the radiant heater reflector and down toward the mattress;

wherein, when the canopy is in the upper open radiant warmer position, an enclosed sheath is stowed behind said radiant heater element to allow the radiant heater assembly to provide a radiant heat effect; and wherein, when the canopy is moved to the lower incubator position, said enclosed sheath is mechanically moved through the opening in the radiant heater reflector to cover the radiant heater element to remove the radiant heat effect from the closed incubator.

2. The infant care apparatus of claim 1, wherein movement of the canopy between the upper open radiant warmer position above said surface and the lower incubator position in which the canopy is positioned on the top of the clear sidewalls is programmed and powered to occur automatically when requested by a user.

3. The infant care apparatus of claim 2, wherein the enclosed sheath is powered to automatically move through the opening in the radiant heater reflector to completely cover the radiant heater element when the infant care apparatus converts from the open radiant warmer configuration to the enclosed incubator configuration.

4. An infant care apparatus that can convert from an open radiant warmer configuration to an enclosed incubator configuration, the infant care apparatus comprising:

a mattress on a base support surface;

clear sidewalls with an open top surrounding said mattress;

a vertical member extending upwardly from said surface; and a canopy containing a radiant heater assembly mounted to said vertical member, the canopy being movable along said vertical member between (i) an upper open radiant warmer position above said surface and (ii) a lower incubator position in which the canopy is positioned on the top of the clear sidewalls forming a closed incubator;

wherein said radiant heater assembly comprises (i) a radiant heater element extending through an opening in a radiant heater reflector and (ii) a radiant heater deflector surrounding a lower end of the radiant heater element for deflecting heat from the radiant heater element onto the radiant heater reflector and down toward the mattress, when the canopy is in the upper open radiant warmer position, in order to provide a radiant heat effect; and wherein, when the canopy is moved to the lower incubator position, said radiant heater reflector is mechanically moved downward relative to the radiant heater element to remove the radiant heat effect from the closed incubator.

5. The infant care apparatus of claim 4, wherein movement of the canopy between the upper open radiant warmer position above said surface and the lower incubator position in which the canopy is positioned on the top of the clear sidewalls is programmed and powered to occur automatically when requested by a user.

6. The infant care apparatus of claim 5, wherein the radiant heater reflector is powered to automatically move downward to encircle the radiant heater element when the infant care apparatus converts from the open radiant warmer configuration to the enclosed incubator configuration.

7. The infant care device of claim 1, wherein the enclosed sheath comprises a tube having a central axis.

8. The infant care device of claim 7, wherein the enclosed sheath is translated along the central axis of the tube when the canopy is moved between the upper open radiant warmer position and the lower incubator position.

9. The infant care device of claim 8, the central axis of the tube is co-linear with a longitudinal axis of the radiant heater element.

10. The infant care device of claim 7, wherein a lower end of the tube is positioned adjacent the radiant heater reflector when the canopy is in the upper open radiant warmer position, and wherein the lower end of the tube is positioned adjacent the radiant heater deflector when the canopy is moved to the lower incubator position.

11. The infant care device of claim 4, wherein, when the canopy is moved to the lower incubator position, the radiant heater reflector is mechanically moved downward relative to the radiant heater deflector.

12. The infant care device of claim 11, wherein a first distance between the radiant heater reflector and the radiant heater deflector when the canopy is in the upper open radiant warmer position is greater than a second distance between the radiant heater reflector and the radiant heater deflector when the canopy is in the lower incubator position.

13. The infant care device of claim 12, wherein the radiant heater reflector is positioned adjacent the radiant heater deflector when the canopy is in the lower incubator position.

14. The infant care device of claim 4, wherein the radiant heater reflector comprises a first side that faces the mattress and a second side opposite the first side.

15. The infant care device of claim 14, wherein the first side of the radiant heater reflector faces the radiant heater element when the canopy is in the upper open radiant warmer position, and wherein the second side of the radiant heater reflector faces the radiant heater element when the canopy is in the lower incubator position.

* * * * *